US010145375B2

(12) United States Patent
Young

(10) Patent No.: US 10,145,375 B2
(45) Date of Patent: Dec. 4, 2018

(54) DISCHARGE MUFFLER

(71) Applicant: J&E HALL LIMITED, Gravesend, Kent (GB)

(72) Inventor: Terence William Thomas Young, Gravesend (GB)

(73) Assignee: J&E HALL LIMITED, Gravesend, Kent (GB)

( * ) Notice: Subject to any disclaimer, the term of this patent is extended or adjusted under 35 U.S.C. 154(b) by 20 days.

(21) Appl. No.: 15/118,865

(22) PCT Filed: Feb. 13, 2015

(86) PCT No.: PCT/GB2015/000055

§ 371 (c)(1),
(2) Date: Aug. 13, 2016

(87) PCT Pub. No.: WO2015/121608

PCT Pub. Date: Aug. 20, 2015

(65) Prior Publication Data

US 2017/0051745 A1 Feb. 23, 2017

(30) Foreign Application Priority Data

Feb. 13, 2014 (GB) ..... 1402573.8

(51) Int. Cl.

| | |
|---|---|
| ***F01C 1/16*** | (2006.01) |
| ***F03C 2/00*** | (2006.01) |
| ***F03C 4/00*** | (2006.01) |
| ***F04C 29/06*** | (2006.01) |
| ***F04C 18/16*** | (2006.01) |
| ***F04C 29/02*** | (2006.01) |
| *F04C 18/52* | (2006.01) |

(52) U.S. Cl.

CPC ..... *F04C 29/065* (2013.01); *F04C 18/16* (2013.01); *F04C 29/026* (2013.01); *F04C 18/52* (2013.01); *F04C 29/061* (2013.01)

(58) Field of Classification Search

CPC ..... F04C 18/16; F04C 18/52; F04C 29/026; F04C 29/061; F04C 29/065

USPC ..... 418/181, 201.1, 270, DIG. 1

See application file for complete search history.

(56) References Cited

U.S. PATENT DOCUMENTS 5,208,429 A * 5/1993 Field ..... F02M 35/12 181/229
6,045,344 A * 4/2000 Tsuboi ..... F04C 18/16 418/201.1

FOREIGN PATENT DOCUMENTS

DE 3839243 A1 5/1990
GB 751881 A 7/1956

* cited by examiner

*Primary Examiner* — Theresa Trieu
(74) *Attorney, Agent, or Firm* — Agris & Von Natzmer, LLP; Joyce Von Natzmer

(57) ABSTRACT

Disclosed is a discharge muffler for a compressor constructed as an inner duct extending inside an outer duct, the inner duct being open at each end and the outer duct being open only at the muffler inlet. The inner duct has a plurality of holes communicating with the outer duct. At least two of the holes are at different distances from the muffler outlet.

17 Claims, 4 Drawing Sheets

DISCHARGE MUFFLER

CROSS REFERENCE TO RELATED APPLICATIONS

This is the U.S. national stage of International application PCT/GB2015/000055, filed Feb. 13, 2015, which claims priority to GB Patent application no. 1402573.8, filed Feb. 13, 2014 and which are incorporated herein by reference in their entireties.

FIELD OF THE INVENTION

The present invention relates to a noise reduction muffler. It finds particular application in an air conditioning or refrigeration system, for instance being fitted to the discharge from a refrigeration or air conditioning compressor before entering the oil separator or refrigeration system. Such separator may be integral with the compressor or mounted separately.

BACKGROUND OF THE INVENTION

FIG. 1 shows an overview of known air conditioning equipment comprising a compressor 14 and an external oil separator 12, these having a connection 17 to heat exchangers (not shown). During a compression process, gas enters the compressor 14 under suction 40. Oil is injected into the compressor 14 to improve efficiency and to provide cooling of the compressor 14. A gas and oil mixture is created in the compressor 14 which is delivered via a first inlet pathway 13 to the oil separator 12. Once separated, the gas is delivered via the connection 17 to the heat exchangers and the oil is delivered via a third pathway 16 back to the compressor 14. The quantity of oil allowed to enter a cooling system such as an air conditioning system must be kept to a minimum if heat exchanger efficiency is to be maintained.

Screw compressors have become increasingly popular for refrigeration and air conditioning applications in recent years. Their high reliability, small size and weight for a given capacity, make these compressors ideal for use in packaged chiller units. Environmental issues are increasingly important and thus also efficient operation of these chillers.

FIG. 2 shows an example of a single screw compressor comprising a single main rotor 100 with two meshing gate rotors 110, 115. The single main rotor 100 has a number of helical flutes 105, which are cut with a globoid (or hour glass) shape to the roots of these threads flutes. The flutes 105 have a relatively large cross section at an input end 120 and a significantly smaller cross section at a discharge end 125.

Suction gas enters the flutes 105 at the large openings at the input ends 120, in a generally axial direction with respect to the main rotor 100. The gas is then sealed into the flutes 105 by the gate rotors 110, 115 and casing (not shown) as the rotor assembly 100, 110, 115 rotates, the discharge ends 125 of the flutes 105 normally being closed by the casing. Continued rotation causes the teeth of the gate rotors 110, 115 to progress along the flutes 105 causing a reduction in volume and thus an increase in pressure. The compressor is so designed that when the desired pressure increase has been reached the flute opens to a discharge port in the casing and continued rotation causes the refrigerant gas to be driven out through the discharge port. The design allows for this compression process to be mirrored on both sides of the main rotor 100 by the use of two gate rotors 110, 115.

FIG. 2 shows a compression process in three different rotational positions. In a first position, shown to the left in FIG. 1, a gas-filled flute 105 has a relatively large volume, indicated by a dotted area. As the input end 120 is sealed by a tooth of a gate rotor 115 which begins to move along the gas-filled flute 105 during rotation of the rotor assembly 100, 110, 115, the volume of the gas-filled flute 105 reduces, as shown in the middle of FIG. 1. The volume of the gas-filled flute 105 reaches a minimum just as its discharge end 125 comes level with a discharge port (not shown) in the casing. This last rotational position is shown to the right in FIG. 1. The gas expands as it is released through the discharge port. This process is repeated for each consecutive flute 105.

SUMMARY OF THE INVENTION

Efficient operation of such compressors and refrigeration systems has become more important in recent times. Operation at reduced capacity can be very important. Such reduced capacity can be achieved in screw compressors by the use of internal slides reducing the swept volume of the compressor. An alternative to such a control system is the use of a variable frequency drive applied to the motor, which provides efficient operation at reduced load/speed. Once such a system has been adopted then operation at higher speed becomes possible. Modern compressors are being designed and produced to operate beyond the normal two pole motor maximum speed. The problem in such applications is one of noise. High speed screw compressors tend to be higher in noise level than their standard speed equivalents.

According to embodiments of the invention in its first aspect, there is provided a discharge muffler for mounting to take discharge from a compressor, the muffler having an inlet for receiving the discharge and an outlet for delivering the discharge, wherein the muffler comprises an inner duct and an outer duct, the inner duct extending inside the outer duct, the inner duct being open at each end and the outer duct being open at a first end in the region of the muffler inlet and having a closure at a second end in the region of the muffler outlet, the inner duct being provided with a plurality of holes communicating with the outer duct, at least two of the holes being at different distances from the muffler outlet.

The inner duct may comprise a tube having a wall, the holes being through the wall.

The muffler inlet can be provided by the open ends of the inner and outer ducts and the muffler outlet is provided by an open end of the inner duct, at the closure of the outer duct. The closure of the outer duct at its second end may be provided by a wall extending inwardly from the outer duct onto the inner duct.

Embodiments of the invention can provide noise reduction in compressors such as the screw compressors described above. Such noise reduction can be, but is not necessarily, sufficient to reduce the noise level of a compressor run at higher speeds down to the same noise level or lower than that of a standard speed compressor.

The inner duct is preferably sized, according to known principles, so as to provide a low pressure drop and may be of a diameter that would conventionally be chosen to ensure minimum pressure drop with regard to the compressor. The outer duct is then sized to provide a chamber of larger diameter around the inner duct, the combination providing reflective acoustic muffling.

This muffler may be fitted between the compressor discharge and the oil separator of an integral oil separator or may be fitted to the compressor outlet or separator inlet when an external oil separator arrangement is adopted. The muffler outlet may therefore be connected to a further duct leading to the separator or may discharge substantially directly into the separator.

Embodiments of the invention have been found to provide significantly lower noise levels, by as much as 10 dBA or more. They can provide a significant reduction in noise level across a wide range of speeds and operating conditions.

Reflective acoustic mufflers are known to have a frequency specific character. In embodiments of the present invention, in order to increase the range or number of frequencies at which the muffler is effective, the inner and outer ducts are preferably offset with respect to each other in a transverse direction across the muffler, the holes in the inner duct being positioned so that they lie at more than one different distance from the outer duct, for instance at least two different distances. Alternatively or additionally, the holes in the inner duct may be positioned so that they lie at more than one different distance from the muffler outlet, preferably at least three different distances. These different distances can be determined in relation to the wavelengths of discharge pulsations for a compressor in use at different respective speeds. Acoustic reflections caused by the holes then allow the muffler to reduce noise with more complex frequency content, such as the increased range or number of frequencies mentioned above. The holes may be positioned as pairs at each distance from the muffler outlet, the holes of each pair being positioned at different distances from the outer duct in a radial direction from the inner duct. Preferably, for good performance, at least two of the holes in the inner duct are at respective distances from the outer duct which are different by a factor of four. Additionally, it is found preferable that the cross sectional area of the inner duct is substantially equal to the cross sectional area between the inner and outer ducts.

In an example of a muffler according to an embodiment of the present invention, the muffler comprises two ducts one within the other where the inner duct has holes conforming to ¼ wavelength positions covering three speeds within an extended speed range for the compressor. The ducts are offset with respect to each other, serving to further extend the muffler range beyond the three optimised positions such that an entire extended speed range is adequately covered.

An example of a speed range might be from 50 to 85 Hz rotational speed of the compressor. This speed range is appropriate for a screw compressor being set from the standard speed to a maximum speed. The standard two pole speed for screw compressors in the UK is 50 Hz and in the US is 60 Hz and thus 50 to 85 Hz covers a typical extended speed range. However speeds as high as 120 Hz are likely to be reached in the near future.

BRIEF DESCRIPTION OF THE FIGURES

A muffler according to an embodiment of the invention will now be described, by way of example only, with reference to the accompanying drawings in which.

The drawings are not drawn to scale.

DESCRIPTION OF VARIOUS AND PREFERRED EMBODIMENTS

Figure 1:
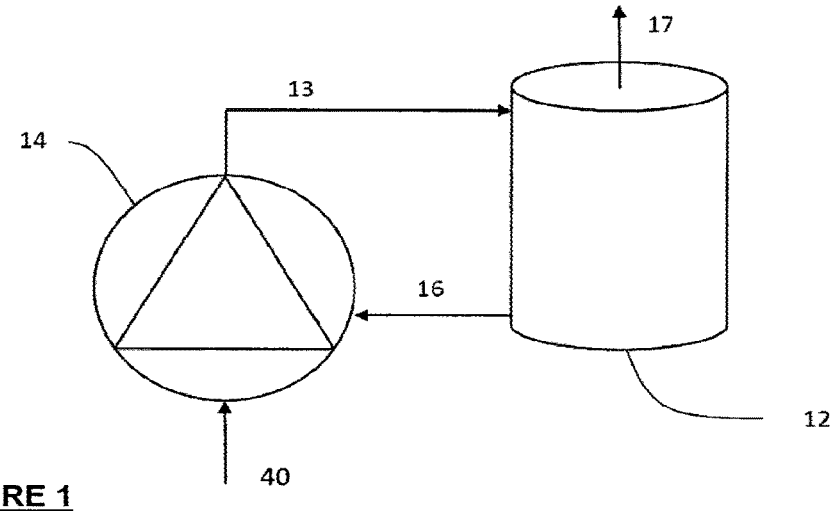
FIGURE 1 PRIOR ART
FIG. 1 shows in block diagram a known compressor/separator layout.
Figure 2:
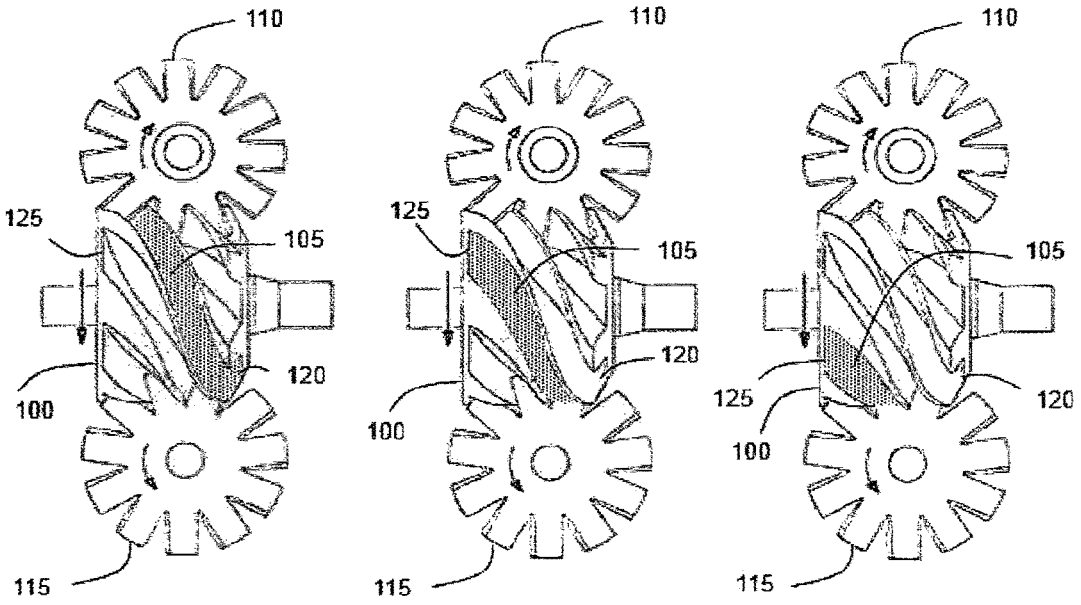
FIGURE 2 PRIOR ART
FIG. 2 shows a known arrangement of screws in a single screw compressor having two gate rotors.
Figure 3:
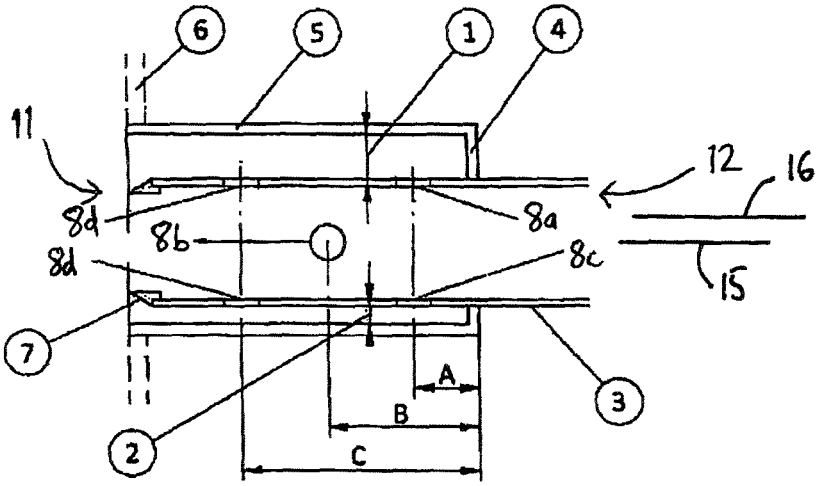
FIG. 3 shows a tilted axial cross section, indicated by the arrows x-x in FIG. 4, through the centreline of the muffler when fitted between the discharge of a compressor and an integral oil separator.
Figure 4:
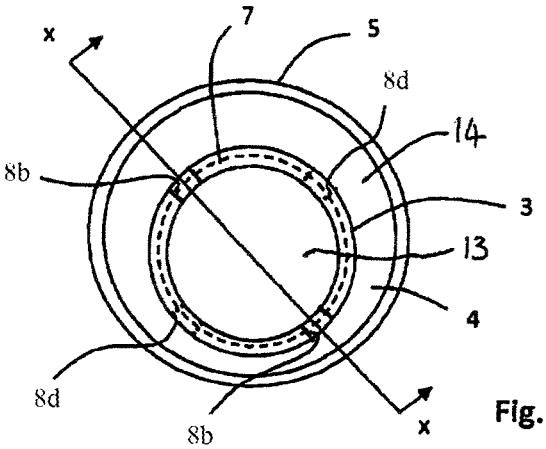
FIG. 4 shows a vertical transverse cross section of the muffler shown in FIG. 3, viewed in the direction of an outlet to the separator.

Referring to FIGS. 3 and 4, the muffler comprises primarily an outer, or surrounding, duct 5 and an inner duct 3. Both ducts 5, 3 are open at a first end to provide the muffler inlet 11, mounted into a discharge aperture in the wall 6 of a compressor. The muffler inlet, in use, receives an oil/gas mixture discharged from the compressor. At its second end, the inner duct 3 is extended, becoming the delivery duct for the gas/oil mixture from the compressor to a gas/oil separator (not shown in FIGS. 3 and 4). The outer duct 5 however is closed at its second end by a transverse end wall 4 which is sealed to the outer surface of the inner duct 3, thus providing a chamber about the inner duct 3. The muffler outlet 12 is thus provided through the inner duct 3 where the end wall 4 closes the outer duct 5.

The discharged gas/oil mixture from the compressor enters both the inner duct 3 and the outer duct 5 at the same time. The frequency content of compressor noise is at least in part determined by the known phenomenon of discharge pulsations. The inner duct 3 has a plurality of holes 8*a*-8*d* in its wall and these are positioned to conform to ¼ wavelength of the discharge pulsations calculated over the required speed range and operating conditions of the compressor in use, in particular where the speed range is to be extended. The holes are positioned in pairs at distances, first and third holes 8*a*, 8*c* at A; second holes 8*b* at B, and fourth holes 8*d* at C from the end wall 4 of the outer duct 5 to the center of the respective hole. The cross section of FIG. 4 is taken through the holes at position C and viewed in the direction of the end wall 4 of the muffler.

In addition, the axes 15, 16 of the inner and outer ducts 3, 5, respectively, are radially offset from each other such that at least two of the holes 8*a*-8*d* at any one of the positions A, B or C are at a different distance from the wall of the outer duct 5. Gas entering the outer duct 5 is reflected back from the end wall 4 and passes through the holes 8*a*-8*d* into the inner duct 3, continuing with the flow in this duct 3 to the muffler outlet and into the oil separator.

The effect of the reflective flow is to introduce a flow into the main flow in the inner duct 3 which is at a ½ wavelength out of time with pulsations in the main flow. This is a recognised noise reduction method which has the effect of damping the pulsations in the main flow. However, it is only achieved for pulsations at one critical frequency. In embodiments of the invention, the effect is extended to cover an increased speed range by the holes positioned at the three distances A, B and C from the end wall 4. These distances can be optimised for different frequencies within the extended speed range, operating together with the radially offset duct arrangement to provide improved noise reduction due to the additional reflection of the wave forms between the two duct sections and the effect on the main reflected wave forms.

Referring to FIG. 3, in an example of the muffler, dimensions may be as follows:

inner duct 3 nominal bore: 4" (outer diameter 114.3 mm)
outer duct 5 nominal bore: 6" (outer diameter 168.3 mm)
uppermost clearance distance marked "1": 32 mm
lowermost clearance distance marked "2": 8 mm
distance "A" from end wall 4 to closest holes 8: 70 mm
distance "B" from end wall 4 to middle distance holes 8: 90 mm
distance "C" from end wall 4 to furthest holes 8: 113 mm
hole diameter: 25 mm An example of guidelines in designing a muffler as described above might be as follows:

STEP 1: identify a critical frequency of the compressor discharge. For a single screw compressor, this is the number of rotor flutes times the rotational frequency.

STEP 2: plot the wavelength of this critical frequency in refrigerant at operational condition against a required extended speed range.

STEP 3: select three different wavelengths covering this extended speed range at minimum, maximum and mid speeds. This is achieved by determining the speed of sound in the refrigerant discharge at the temperature and pressure at operational condition and dividing this by the known discharge gas critical frequency. This is calculated for three frequencies over the extended speed range to cover the minimum, maximum and mid speeds of the selected extended range. These give the ¼ wavelength dimensions "A", "B" and "C" in FIG. 3

STEP 4: to establish the length of the muffler, the holes at distance "C" are positioned at a distance from the muffler inlet which is 0.6× the diameter of the outer duct 5. This dimension is not critical and may be varied to minimise pressure drop.

STEP 5: the radial offset of the axes of the outer and inner ducts is such that the uppermost clearance distance marked "1" is four times the lowermost clearance distance marked "2".

STEP 6: the area of the cross section of the outer duct 5 should be twice the area of the cross section of the inner duct 3, or to put it another way, the area 14 of the cross section between the ducts 3, 5 should equal the area 13 of the cross section of the inner duct 3.

Referring to FIG. 3, in a further embodiment of the invention an additional inlet restriction 7 is added to reduce the pressure in the inner duct 3 compared with the outer duct 5 and thus increase the flow from the outer to inner duct 5, 3, further enhancing the muffler performance.

Figure 5:
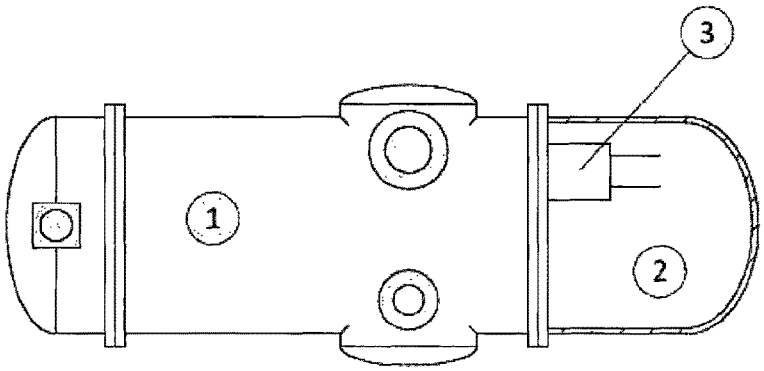
FIG. 5 shows schematically the muffler position in a compressor with an integral separator.
Figure 6:
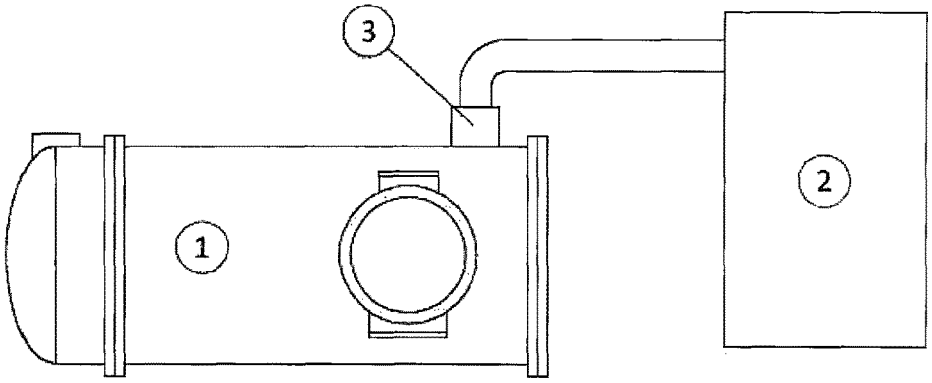
FIG. 6 shows schematically the muffler position when fitted on a compressor with a remote oil separator.

Referring to FIG. 5, the position of the muffler in an integral compressor arrangement might be inside the separator 2 at the discharge from the compressor 1. Referring to FIG. 6, a typical position for the muffler is again at the discharge from the compressor 1 when the oil separator 2 is mounted separate to the compressor 1. In FIG. 6, it can be seen that the axes of the inner and outer ducts 3, 5 are vertical rather than horizontal. In each of these configurations it can be seen that the muffler can effectively provide the discharge outlet of the compressor.

Figure 7:
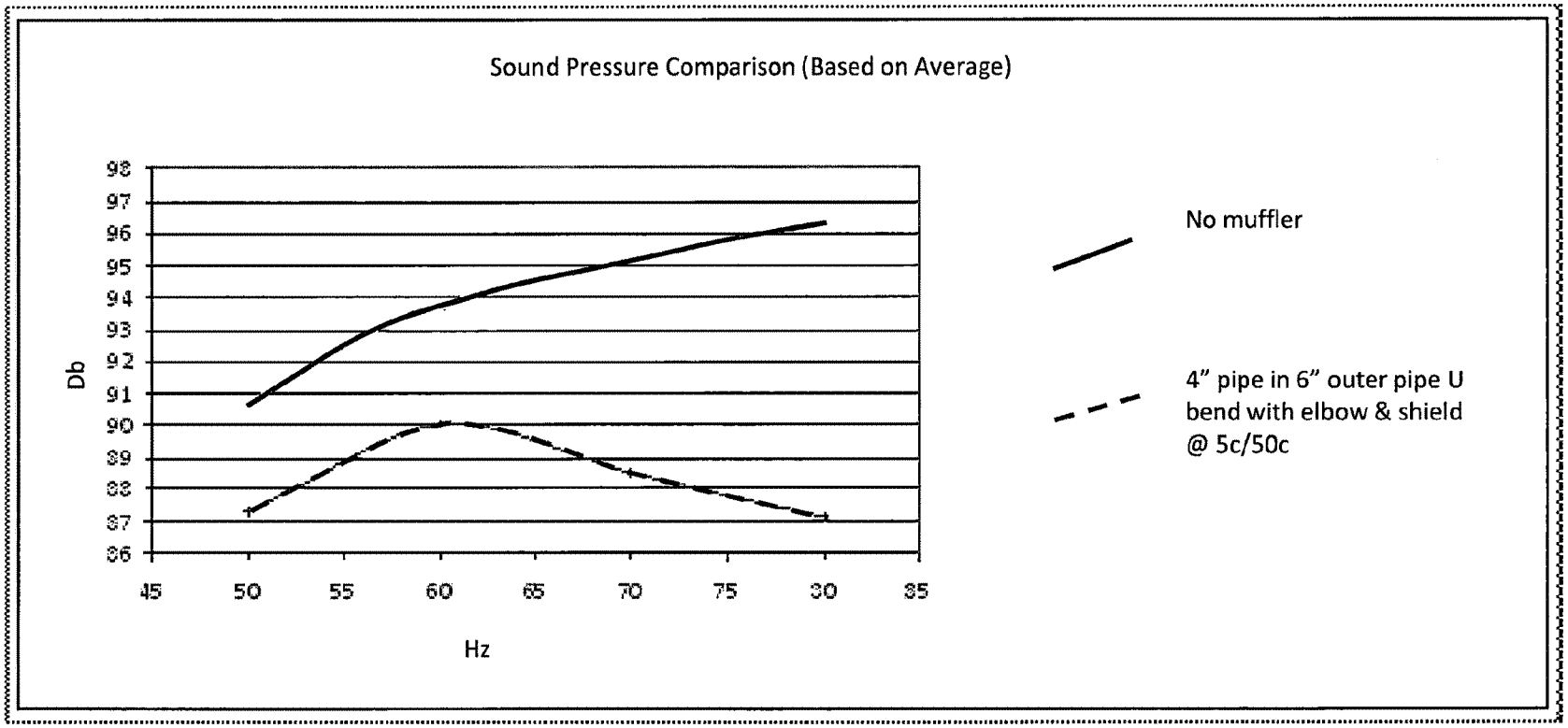
FIG. 7 shows a graph of test results for noise levels with and without the muffler fitted in relation to a compressor.

FIG. 7 shows a graph of test results showing noise levels measured for a compressor with and without a muffler fitted. Maximum noise reduction was achieved at maximum rotational speed of the compressor measured in Hz. Significant noise reduction can be seen.

Several variations may be made in the design of a muffler according to the present invention. For example, the holes 8*a*-8*d* and the inner and outer ducts 3, 5 are not necessarily of circular cross section. The radial offset between the axes of the ducts 3, 5 is not necessarily in a vertical plane but might be in a horizontal or other plane or the direction of the offset might be reversed so that the ducts 3, 5 are at their closest point at the top rather than at the bottom of their cross sections. Indeed the muffler does not necessarily run horizontally but may be vertical or otherwise arranged. The outer duct 5 in particular may be replaced by a duct in another component rather than being provided in the form of a tube having a tube wall. The size of the holes in relation to each other or to other dimensions in the muffler may be varied, depending on the design priorities. For example, larger holes may be found to offer a lower pressure drop in the muffler while smaller holes may be found to offer better noise reduction. The inner duct may not have a simple, continuous tube construction but might comprise more than one component along its length, potentially offering for example additional muffling and/or pressure adapting characteristics.

The invention claimed is:

1. A discharge muffler for mounting to take discharge from a compressor, the muffler having a muffler inlet for receiving the discharge and a muffler outlet for delivering discharge, wherein the muffler comprises:

an inner duct having an axis and an outer duct having an axis, the inner duct:

extending inside the outer duct, being open at each end, and being provided with at least first, second and third holes that communicate with the outer duct, the first and second holes being at different distances from the muffler outlet, and the outer duct:

being open at a first end in a region of the muffler inlet, and having a closure at a second end in a region of the muffler outlet, the axis of the inner duct being offset from the axis of the outer duct so that a clearance between the inner duct and the outer duct is different when measured in different radial directions from the inner duct and the first and third holes in the inner duct are therefore at different distances from the outer duct.

2. The muffler according to claim 1, wherein the muffler is configured for use with the compressor and wherein the different distances from the muffler outlet of the first and second holes are determined in relation to wavelengths of discharge pulsations for the compressor in use at different respective speeds.

3. The muffler according to claim 2, wherein the first, second and third holes are at different distances from the muffler outlet, the distances being determined in relation to the wavelengths of discharge pulsations for the compressor in use at least three different respective speeds.

4. The muffler according to claim 2, wherein the different distances of the holes from the muffler outlet are each a quarter wavelength of a discharge pulsation for the compressor in use at different respective speeds.

5. The muffler according to claim 2, wherein the inner duct is provided with a fourth hole, and said first, second and fourth holes are at different distances from the muffler outlet, the distances being determined in relation to the wavelengths of discharge pulsations for the compressor in use at least three different respective speeds.

6. The muffler according to claim 1, wherein the muffler is configured for use with the compressor and wherein the compressor is a screw compressor.

7. The muffler according to claim 6, wherein the discharge is an oil/gas mixture.

8. The muffler according to claim 1, wherein the muffler inlet is provided by open ends of the inner and outer ducts and the muffler outlet is provided by an open end of the inner duct, at the closure of the outer duct.

9. The muffler according to claim 1, wherein the closure of the outer duct at its second end is provided by a transverse wall extending inwardly from the outer duct onto the inner duct.

10. The muffler according to claim 1, fitted between a compressor discharge and an integral oil separator.

11. The muffler according to claim 1, fitted directly to a compressor discharge outlet.

12. The muffler according to claim 1, wherein the first and third holes in the inner duct are at distances from the outer duct which are different by a factor of four.

13. The muffler according to claim 1, wherein a cross sectional area of the inner duct is substantially equal to a cross sectional area between the inner and outer ducts.

14. The muffler according to claim 1, wherein the muffler is configured for use with a compressor and wherein the inner duct is provided with an inlet restriction to reduce a pressure in the inner duct compared with that in the outer duct.

15. The muffler according to claim 1, dimensioned and configured for use with a single screw compressor operating over a range of rotational speeds from at least 50 to 75 Hz.

16. The muffler according to claim 15, wherein the single screw compressor operates at rotational speeds of up to at least 85 Hz.

17. Cooling equipment comprising a muffler according to claim 1, wherein the muffler is configured for use with the compressor and is mounted to take oil/gas discharge from the compressor for delivery to an oil/gas separator.

* * * * *